United States Patent [19]

Morishita et al.

[11] Patent Number: 4,902,249

[45] Date of Patent: Feb. 20, 1990

[54] ASSEMBLY OF ELECTRICAL CONNECTOR AND A SHIELD CABLE

[75] Inventors: Yoshimasa Morishita, Hyogo; Yoshitaka Shobara, Osaka, both of Japan

[73] Assignee: Nippon Acchakutanshi Seizo Kabushiki Kaisha, Osaka, Japan

[21] Appl. No.: 360,218

[22] Filed: Jun. 2, 1989

[30] Foreign Application Priority Data

Jun. 4, 1988 [JP] Japan ..... 63-74624[U]

[51] Int. Cl.[4] ..... H01R 13/648

[52] U.S. Cl. ..... 439/610; 439/98

[58] Field of Search ..... 439/607, 608, 609, 610, 439/99, 98, 585, 578, 583, 584; 29/862; 174/75 C, 35 C

[56] References Cited

U.S. PATENT DOCUMENTS

| | | | |
|---|---|---|---|
| 4,026,628 | 5/1977 | Duffner | 439/585 |
| 4,415,223 | 11/1983 | Asick | 439/610 |
| 4,433,206 | 2/1984 | Lewis | 439/610 X |
| 4,447,100 | 5/1984 | Dyce et al. | 439/607 X |
| 4,457,576 | 7/1984 | Cosmos | 439/610 |
| 4,653,836 | 3/1987 | Peele | 439/610 |

FOREIGN PATENT DOCUMENTS

| | | | |
|---|---|---|---|
| 90539 | 10/1983 | European Pat. Off. | 439/607 |
| 2119178 | 11/1983 | United Kingdom | 439/610 |

*Primary Examiner*—William Briggs

*Attorney, Agent, or Firm*—Antonelli, Terry & Wands

[57] ABSTRACT

An assembly of electrical connector and a shield cable, the assembly including a shield cover comprising a pair of halved shells of electric conductor, each shell having a connector receiving section at its front end and a cable receiving section at its rear end, the cable receiving sections of the shells joined maintaining a shield meshwork uncovered from the shield cable, wherein the shield meshwork is fastened by a first ferrule, with its top portion being turned back so as to wrap the first ferrule, a metal foil placed over the turned shield meshwork, a second ferrule fitted around the cable receiving section under compression so as to fasten the cable receiving section, thereby effecting electrical connection between the connector and the shield cable.

2 Claims, 3 Drawing Sheets

ASSEMBLY OF ELECTRICAL CONNECTOR AND A SHIELD CABLE

BACKGROUND OF THE INVENTION

The present invention relates generally to an electrical connection between an electrical connector and a shield cable. More particularly, the present invention relates to an assembly of electrical connector and a shield cable against electromagnetic interference.

To protect electronic apparatus against elecromagnetic interference, a shield cover is commonly used which comprises a pair of halved shells produced by a press. The halved shells are joined with maintaining a connector between their joined front ends and a shield layer of the shield cable between their joined rear ends, which are shaped in the form of mouthpieces.

As is generally known, the shield cable is constantly subjected to external forces, and because of them the joint between the shield cover and the shield cable are likely to slacken or sometimes become disconnected.

Accordingly, an object of the present invention is to provide an electrical connector including a shield cover firmly connected to the shield cable to withstand any external force exerting on the cable.

Other objects and advantages of the present invention will become more apparent from the following detailed description, when taken in conjunction with the accompanying drawings which show, for the purpose of illustration only, one embodiment in accordance with the present invention.

SUMMARY OF THE INVENTION

According to the present invention, there is provided an assembly of electrical connector and a shield cable against electromagnetic interference, the assembly comprising a shield cover comprising a pair of halved shells of electric conductor, each shell having a connector receiving section at its front end and a cable receiving section at its rear end, the cable receiving sections of the shells joined maintaining a shield meshwork uncovered from the shield cable, wherein the shield meshwork is fastened by a first ferrule, with its top portion being turned back so as to wrap the first ferrule, a metal foil placed over the turned shield meshwork, an second ferrule fitted around the cable receiving section under compression so as to fasten the cable receiving section, thereby effecting electrical connection between the connector and the shield cable.

DETAILED DESCRIPTION OF THE PREFERRED EMBODIMENT

Figure 1:
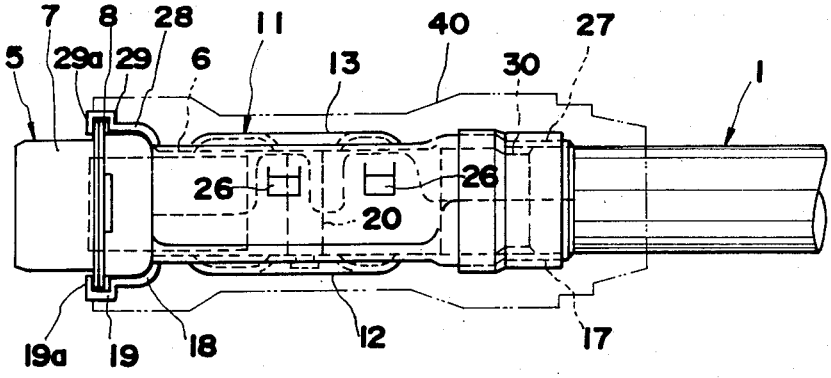
FIG. 1 is a front view showing an electrical connector including a shield cover according to the present invention.
Figure 8:
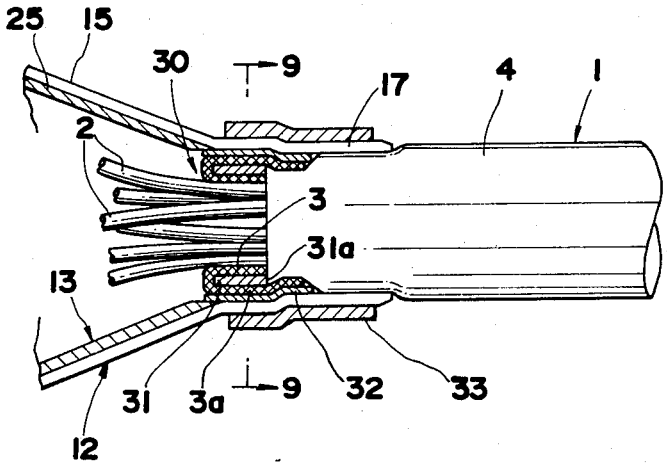
FIG. 8 is a cross-sectional view showing the joint between the shield cable and the joined shells.
Figure 9:
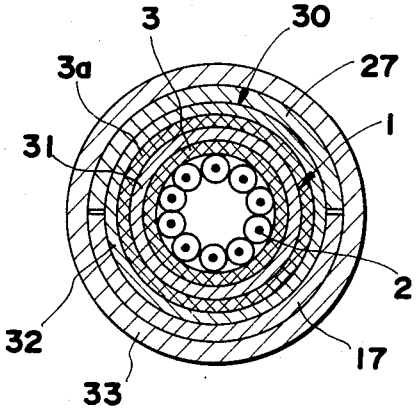
FIG. 9 is a cross-sectional view taken along the line 9—9 in FIG. 8.

Referring to FIGS. 8 and 9, there is provide a shield cable 1 which includes a plurality of insulation-clad wires 2, a shield meshwork 3 surrounding the wires 2 and an insulating covering 4. Each wire 2, as shown in FIG. 1, is connected to each contact (not shown) individually arranged in a housing 6 of a connector 5. The connector 5 has a shield conductor 7 which surrounds the housing 6, and the shield conductor 7 has a flange 8 for engagement with a shield covering 11.

The shield covering 11 consists of a pair of halved shells 12, 13 made by pressing an electrically conductive metal such as mild steel panel. The shells 12 and 13 are plated with nickel.

Figure 2:
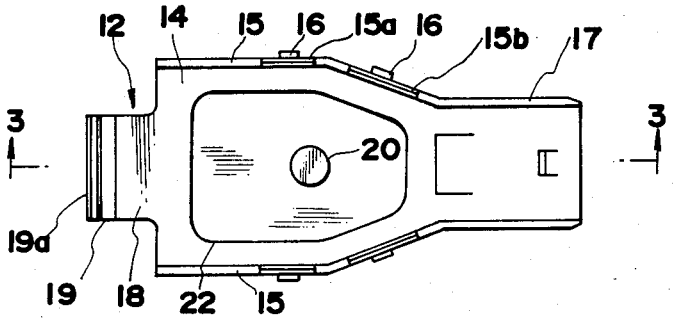
FIG. 2 is a front view showing a halved shell constituting the shield cover shown in FIG. 1.
Figure 3:
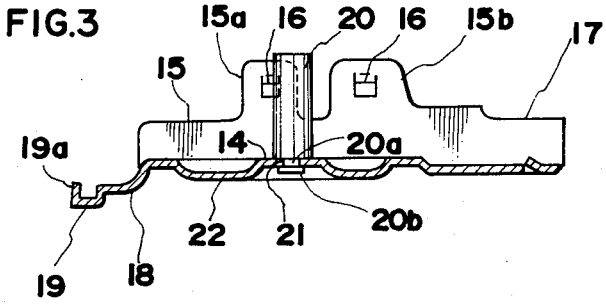
FIG. 3 is a cross-section taken along the line 3—3 in FIG. 2.

The shell 12, as shown in FIGS. 2 and 3, is provided with side plates 15 erected on rims of its bottom plate 14. The side plates 15 include hill portions 15*a*, 15*b* which include engagers 16 projecting outward. The bottom plate 14, as shown in FIG. 2, progressively becomes narrow toward its rear end, and has a mouthpiece 17 at its terminating end which is engaged with a shield layer 30 exposed from the shield cable 1. The bottom plate 14 also has a tongue 18 at its front end which has an engaging section 19 including a hook 19*a*. The hook 19*a*, as shown in FIG. 3, is slightly bent upward so as to facilitate the engagement with a flange 8 of the shield conductor 7.

The bottom plate 14 is provided with a metal post 20 upright at its center. The post 20 has its lower end 20*a* having a reduced diameter inserted into an aperture 21 in the bottom plate 14, and a protruded portion 20*b* is crushed therein to secure the anchorage of the post 20. Alternatively it is possible to weld the post 20 to the bottom plate 14.

The reference numeral 22 denotes a reinforcing bulged portion.

Figure 4:
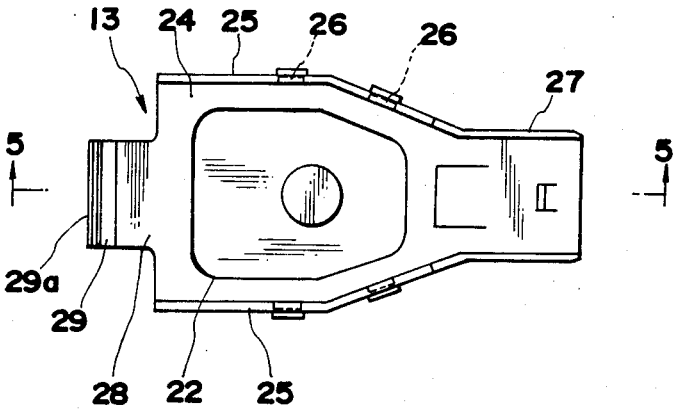
FIG. 4 is a front view showing another halved shell mating with that shown in FIG. 1.
Figure 5:
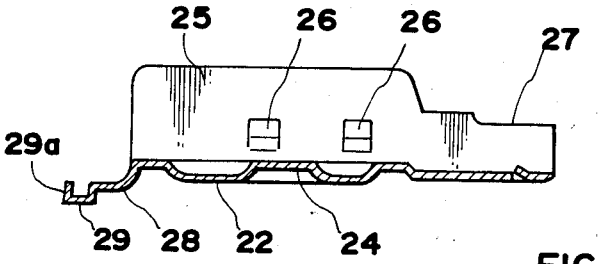
FIG. 5 is a cross-section taken along the line 5—5 in FIG. 4.

The shell 13, as shown in FIGS. 4 and 5, is basically identical in shape with the shell 12. Specifically, the shell 13 has a bottom plate 24 and side plates 25 erected on rims of the side plate 25. The side plate 24 includes receiving engagers 26 mating with the projecting engagers 16 of the side plates 15. The bottom plate 24 progressively becomes narrow toward its rear end, and has a mouthpiece 27 at its terminating end which is engaged with the shield layer 30 of the shield cable 1. The bottom plate 24 also has a tongue 28 at its front end, the tongue 28 including a hook 29*a* bent upward.

As shown in FIGS. 8 and 9, the shield layer 30 will be described in detail:

The shield meshwork 3 is exposed from the shield cable 1, and the shield meshwork 3 is fastened by an inner ferrule 31 around it. The top end portion of the shield meshwork 3 is turned outward to wrap the ferrule 31. The turned top end portion of the shield meshwork 3 will be referred to as an ear portion 3*a* which is covered with an electric conductor layer such as a copper foil 32. The inner ferrule 31 is a ring made by slicing a metal pipe, plated with copper or tin. Alternatively the inner ferrule 31 can be C-shape in cross-section.

There is provided an outer ferrule 33 which is also obtained by slicing a metal pipe and is virtually as long as the mouthpieces 17 and 27 of the shells 12 and 13. The outer ferrule 33 has an inside diameter sufficient to enable itself to cover the joined mouthpieces 17 and 27 with no gap interposed therebetween.

Figure 6:
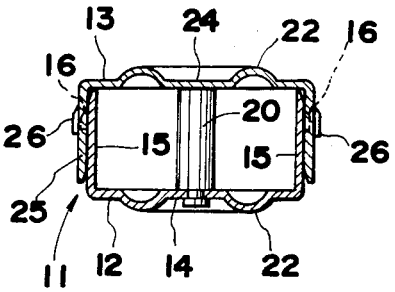
FIG. 6 is a vertical cross-sectional view showing the joined halved shells.

The shield covering 11 is fabricated as follows:

The shells 12 and 13 are joined as shown in FIG. 6 such that the side plates 15 are situated inside the side plates 25 with the projecting engagers 16 of the shell 12 being engaged with the receiving engagers 26. When the two shells 12 and 13 are joined, the post 20 of the shell 12 is abutted with the inside wall of the shell 13.

At the front end of the shield covering 11 the two engagers 19 and 29 are opposite to each other with a space in which the conductor 5 wherein the respective hooks **19*a* and 29*a* engage the flange 8 of the conductor 5 to effect the joint between the conductor 5 and the shield casing 11. In this way the conductor 5 is secured to the front ends of the shells 12 and 13. The mouthpieces 17 and 27 of the shells 12 and 13 jointly receive the shield layer 30 of the cable 1 as shown in FIG. 8. In this situation the outer ferrule 33 is compressed to enable the mouthpieces 17 and 27 to hold the shield layer 30 firmly therebetween. In this way electrical and mechanical connection is established between the shells 12, 13 and the shield layer 30. When the outer ferrule 33 is compressed, the mouthpieces 17 and 27, the copper foil 32 and the turned ear portions 3*a* of the shield meshwork 3 are forced inward along the rear end 31*a* of the inner ferrule 31. The turned ear portions 3*a* of the shield meshwork 3 is inserted between the inner ferrule 31 and the mouthpieces 17, 27, thereby securing the shield meshwork 3 to the jointed shells 12 and 13. As a result, the joint between the shells 12 and 13 withstands external force exerting on the shield cable 1. In this way the firm electrical connection between the shield layer 30 of the cable 1 and the shield conductor 7 of the connector 5 through the shells 12 and 13** is established against electromagnetic interference.

Finally the assembly of the shield cable 1 and the joined shells 12, 13 and the shield covering 11 are covered with an insulating cover 40 as indicated by imaginary lines in FIG. 1. The insulating cover 40 is molded with an insulating plastic such as polyvinyl chloride by injection.

When the cover is 40 is molded, a large pressure exerts on the shells 12 and 13 but the post 20 of the shell 12 prevents the joined shells 12 and 13 from deforming or fracturing.

Figure 7:
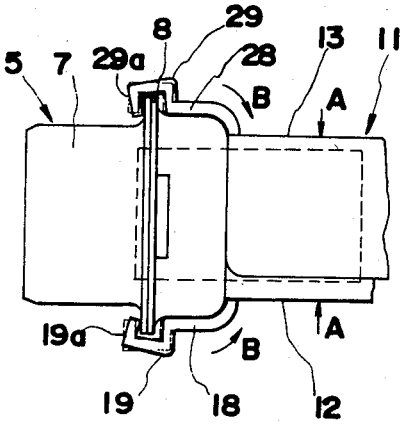
FIG. 7 is a front view showing the joint between the connector and the joined shells.

As shown in FIG. 7, if an external force (A) exerts on the joined shells 12 and 13 because of the injection, the engagers 19 and 29 will undergo a pull (B). However, the hooks **19*a* and 29*a* are inwardly declined to be engaged with the flange 8, so that the engaging sections 19 and 29 are elastically deformed to avert the detrimental pull (B) as indicated by dotted lines in FIG. 7. Thus the engaging sections 19 and 29 are firmly secured to the flange 8**. The electrical connection is thus established.

What is claimed is:

1. An assembly of electrical connector and a shield cable against electromagnetic interference, the assembly comprising a shield cover comprising a pair of halved shells of electric conductor, each shell having a connector receiving section at its front end and a cable receiving section at its rear end, the cable receiving sections of the shells joined maintaining a shield meshwork uncovered from the shield cable, wherein the shield meshwork is fastened by a first ferrule, with its top portion being turned back so as to wrap the first ferrule, a metal foil placed over the turned shield meshwork, an second ferrule fitted around the cable receiving section under compression so as to fasten the cable receiving section, thereby effecting electrical connection between the connector and the shield cable.

2. An assembly as set forth in claim 1, wherein the connector receiving section of each halved shell is engaged with a flange produced in a shield conductor of the connector, and wherein the connector receiving section includes an inwardly bent end so as to secure the engagement with the flange.

* * * * *